United States Patent [19]

Mierzwinski

[11] 4,447,692

[45] May 8, 1984

[54] CONTROL SYSTEM WITH INTERACTIVE DISPLAY

[75] Inventor: Eugene P. Mierzwinski, Fort Wayne, Ind.

[73] Assignee: Essex Group, Inc., Fort Wayne, Ind.

[21] Appl. No.: 264,731

[22] Filed: May 18, 1981

[51] Int. Cl.[3] ..... H05B 9/06

[52] U.S. Cl. ..... 219/10.55 B; 340/365 C

[58] Field of Search ..... 219/10.55 B, 10.49; 364/900; 340/365 R, 365 C, 365 VL, 337

[56] References Cited

U.S. PATENT DOCUMENTS

| | | | |
|---|---|---|---|
| 3,200,375 | 8/1965 | Lutz | 340/365 VL |
| 3,971,013 | 7/1976 | Challoner et al. | 340/337 |
| 4,011,428 | 3/1977 | Fosnough et al. | 219/10.55 B |
| 4,078,257 | 3/1978 | Bagley | 364/900 |
| 4,110,749 | 8/1978 | Janko et al. | 340/365 R |
| 4,112,429 | 9/1978 | Tsuha et al. | 340/365 R |
| 4,114,190 | 9/1978 | Mazuir | 364/900 |

*Primary Examiner*—B. A. Reynolds
*Assistant Examiner*—M. M. Lateef
*Attorney, Agent, or Firm*—Stephen A. Schneeberger

[57] ABSTRACT

A control system for an appliance, such as a microwave oven or the like, is provided with an adaptive manual input and a display positioned in visual proximity with one another. Various operating sequences and/or modes of the appliance are represented by symbols which may be displayed. Those operating sequences may be selected for implementation by actuating an input associated with the respective display. The symbols are contained in a plurality of groups which are displayed separately in time from one another. Actuation of a particular input associated with the display of a particular symbol also serves to display a new symbol group in accordance with a predetermined programming schedule. Typically, the functional sequences of the appliance are organized as a plurality of selectable principal modes each comprised of one or more selectable modes or sequences. Various prompting statements may also be automatically displayed to aid the user in programming the control system. The adaptive input may be part of a capacitive touch-type keyboard and comprise transparent touch keys overlying respective display devices.

21 Claims, 18 Drawing Figures

FIG.5A

DOMINANT

FUNCTIONS

| | | | |
|---|---|---|---|
| MICRO | BAKE | BROIL | PRINCIPAL |
| PR HEAT | AUTO TM | HOLD | |
| RECIPE | CLOCK | CLEAN | |
| TIME | DEF | PROBE | SECONDARY |
| DELAYED | YES | NO | |
| CK TM | FIN TM | /FWD | |
| SIMULT | M DELY | CALC | |
| TIMED | AUTO | PROBE | |
| COMBO | YES | NO | |

FIG. 5B

PROMPTING STATEMENTS

| |
|---|
| ENTER TIME OF DAY |
| START TIME HRS/MIN |
| FINISH TIME HRS/MIN |
| OVEN TEMP DEG F |
| BROIL TEMP DEG F |
| COOK TIME MIN/SEC |
| PWR LVL 0-99 OR FWD |
| COOK TIME HRS/MIN |
| ENTER MIN AND SEC |
| ENTER HRS AND MIN |
| TOUCH START OR FWD |
| ENTER TEMP 100-200F |
| ENTER TEMP 150-550F |
| ENTER COOK TIME OR FWD |
| ENTER FIN TIME OR FWD |
| ENTER BEGIN TIME OR FWD |
| SELECT RECIPE 1-20 |
| TOUCH START |

CONTROL SYSTEM WITH INTERACTIVE DISPLAY

DESCRIPTION

1. Technical Field

The present invention relates to a control system and to a display which is interactive with the control system, and more particularly to a control system having a display interactive therewith and being utilized to control an appliance such as a microwave oven or the like.

2. Background Art

A rapidly increasing number of electrically-controlled appliances, such as microwave ovens, dishwashers, and the like, are being controlled by miniaturized digital processors which respond to various types of manually-actuated input switches or keys to perform certain functions in accordance with control sequences determined by stored programs and by data and commands provided via the manual input devices. Most of these control systems are accompanied by some type of display which visually reveals some of the data entered into the processor, which may reveal certain performance characteristics such as time-keeping and/or which may also indicate a particular operational status or mode of the control system. As the capability of such control systems has expanded, principally due to the increased miniaturization of the relevant circuitry, system designers have sought to incorporate increasing numbers of functions into the control devices and the control systems. Concomitantly, the increase of selectable operating modes available to the user has necessitated larger input switch panels or keyboards. One technique for minimizing the proliferation of input switch devices is exemplified by the use of overlays on the switches or key pads to change the identification of the function to be controlled through the input. Such overlays, used for instance with typewriter keyboards, may require manually changing certain of the mechanical typing elements and the overlay itself.

In another instance disclosed in U.S. Pat. No. 3,819,722 for Interactive Input Output Computer Terminal with Automatic Relabeling of Keyboard, optical projection means are used for form variable images on a keyboard. This technique, however, employs relatively large and complex equipment.

In U.S. Pat. No. 4,078,257 for Calculator Apparatus with Electronically Alterable Key Symbols, there is disclosed a keyboard "underlay" arrangement for a calculator in which various symbols may be stored beneath respective transparent input switches on a plurality of transparent, individually selectively activated, display planes. The user selects, via a keyboard entry, a particular plane for activation. When a particular plane is activated, the input keys assume the respective functions of the displayed symbols of that plane. Mention is made of automatically following one such display format with another which logically follows upon completion of operations associated with the former. Alternatively, there may be a single display plane on which can be formed and displayed various symbols obtained from a read-only-memory.

A Programmable Key/Display/Switch Device is described at pages 442–444 of the IBM Technical Disclosure Bulletin, Vol. 21, No. 2, July 1978. That device provides for electronically altering the labels on and the resulting switch functions of the key buttons of a keyboard. A 5×7 matrix of light-emitting diodes (LEDs) or liquid crystal displays is suggested for each key. Operator prompting under computer control is said to be possible.

It is a principal object of the present invention to provide an improved control system for an appliance, such as a microwave oven, having controlled devices operative in a plurality of selectively programmable sequences. Included within this object are the provision of a control hierarchy and of displayed instructions for facilitating operation of the appliance by the user.

It is a further object to provide an adaptive control panel for use in such aforementioned control systems.

DISCLOSURE OF INVENTION

In accordance with the present invention, there is provided an improved control system for an appliance having controlled devices operative in a plurality of selectively programmable sequences. The control system includes manually actuable adaptive input means, display means in visual proximity with the input means and electronic control means and storage means. The controlled devices of the appliance operate in a plurality of selectable modes each comprising one or more operating sequences. Representations of symbols each intuitively representative of a respective operating mode are in storage. The control means selectively displays at the display means various different groups of symbols retrieved from storage and correspondingly recognizes inputs from the adaptive input means as functionally corresponding with the displayed symbols. The control means responds to operation of an adaptive input means while a particular mode symbol is displayed by subsequently effecting the operating sequence associated with the respective displayed mode symbol.

The operating modes are comprised of principal operating modes, and secondary operating modes subservient to the principal operating modes. At least one of the principal modes is comprised of a plurality of alternately selectable ones of the secondary modes, and the symbols for the latter are displayed in one or more groups separate from the former. Typically, a group of symbols includes three symbols. In a preferred embodiment, one of the groups of principal operating modes is dominant, and the symbol groups therefor is automatically displayed first and in most instances is automatically displayed again following completion of certain programming steps including the entry of data. One dedicated input switch or key initiates a stepping command for retrieving from storage and displaying a subsequent different one of the operating mode symbol groups, and another such switch initiates a starting command to being executing the stored sequences.

Various predetermined prompting statements are in storage and the control means recalls and displays the appropriate statement following operation of an adaptive input means in order to assist with the subsequent input of data with a dedicated input device.

Several transparent touch-responsive capacitive switches superimposed over a multi-character alphanumeric vacuum fluorescent display panel provide a preferred arrangement for the input means and the display means. Each transparent capacitive switch comprises a pair of serially-connected capacitors formed of a sheet of transparent dielectric having a transparent electrode on the upper surface thereof to form the intermediate plate and a pair of spaced electrodes on the under surface thereof to form the opposite end plates.

BRIEF DESCRIPTION OF THE DRAWINGS

FIGS. 5*a* and 5*b* comprise tables listing functions and prompting statements respectively for selective display in conjunction with the adaptive input switches of the control panel;

BEST MODE FOR CARRYING OUT THE INVENTION

Figure 1:
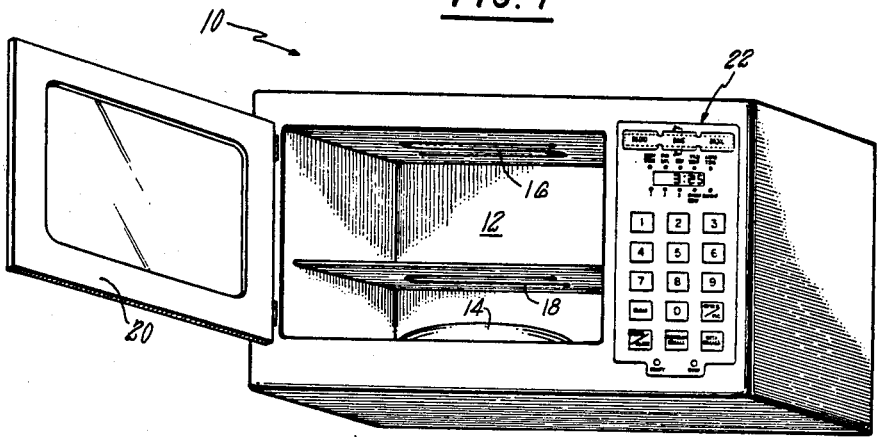
FIG. 1 is a perspective view of a combination microwave and thermal oven incorporating the control system of the present invention.

Referring to FIG. 1, there is illustrated a combination microwave and thermal oven 10 which employs a control system in accordance with the present invention. It should be understood that the oven 10 is only illustrative but the control system of the invention might be used with other appliances. An antenna housed within dome 14 at the bottom of cavity 12 couples microwave energy from a waveguide system (not shown) supplied by a magnetron (not shown) into the cavity. Moreover, the oven 10 includes an electrical resistance heating element 16 at the top of cavity 12 for browning and/or broiling the food contained within the cavity, and a second electrical resistance heating element 18 located at the bottom of cavity 12 for baking the food. A hinged door 20, here shown open, is closed and latched preparatory to and while the food is being cooked in cavity 12. The present invention is particularly suited for use with the combination oven 10 because the provision of both microwave and thermal cooking elements within a common cooking cavity 12 significantly increases the number and types of cooking sequences available to the user.

A control panel 22 is positioned at the front of oven 10 to the side of cavity 12 for convenient access and operation by the user. The control panel 22 is conventional in most respects, including mechanical, manually operated start and stop switches 21 and 23, respectively and an array of touch-responsive capacitive key pads 24 having fixed, or dedicated, values or functions assigned thereto and indicated thereon by printed indicia. Each of the key pads 24 may be operated, or activated, by the user placing a finger thereon so as to change the capacitance of the associated switch and correspondingly attenuate a voltage level appearing thereat, which voltage attenuation serves as an input signal to the microcomputer and other circuitry to be hereinafter discussed with reference to FIG. 4. Such capacitive touch-responsive input keyboards are well known and a more detailed description thereof, particularly in use with a microwave oven, may be obtained from U.S. Pat. No. 4,011,428 issued Mar. 8, 1977 to Fosnough et al for Microwave Oven Timer and Control Circuit and U.S. Pat. No. 4,056,699 issued Nov. 1, 1977 to L. S. Jordan for Touch Plate Assembly, both being incorporated herein by reference to the extent consistent herewith.

In addition to the dedicated capacitive touch pads of keys 24, the control panel 22 includes a conventional four digit numerical display 26. The display 26 consists of a seven-segment, four-digit vacuum fluorescent device and operates to display the time remaining in a cook cycle or the time of day or various other types of numerical information. An array of 10 annunciator bars arranged above and below the display 26 serve to visually indicate the occurrence of certain steps in the cooking program and/or operational modes when illuminated.

In accordance with an aspect of the invention, the control panel 22 additionally includes at least one, and in the illustrated embodiment three, dynamically-alterable input key pads indicated collectively by reference numeral 30 and individually by reference letters A, B and C respectively. The indicia associated with and appearing at the respective key pads A, B and C are electronically variable and, in those instances in which those key pads are used as input switches, the functions of the respective input signals are correspondingly varied. Moreover, certain of the information appearing at the alterable key pads 30 may be solely for prompting a certain response by the user. While such prompting information is being displayed the key pads 30 cease to function as input devices to the remainder of the control system. For the foregoing reasons, key pads 30 may be said to comprise part of an adaptive keyboard.

Figure 3:
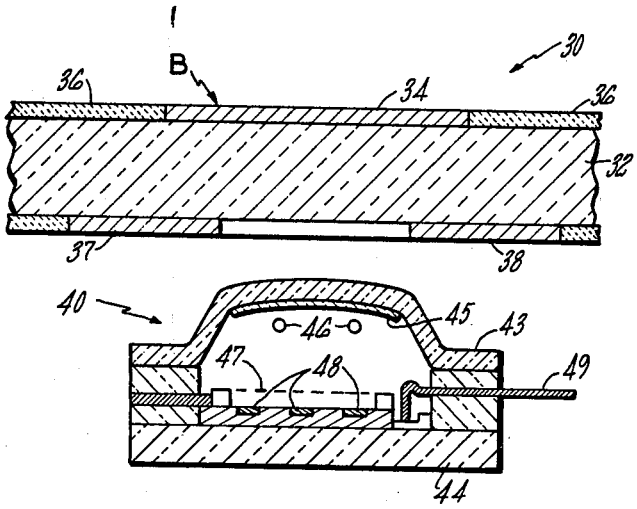
FIG. 3 is a sectional view taken along lines 3—3 of FIG. 2 and illustrating a portion of one of the adaptive input switches on the control panel.
Figure 4:
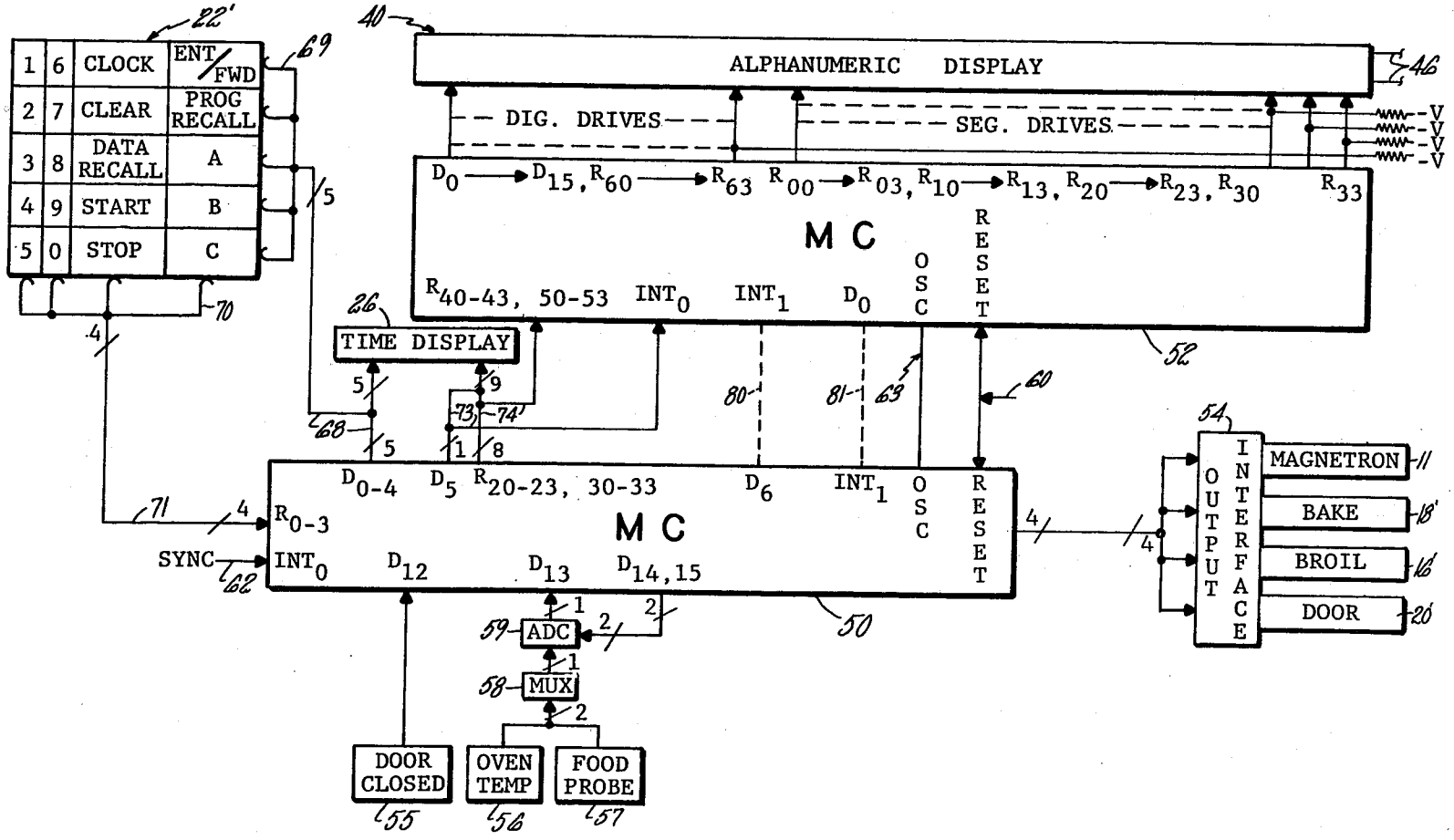
FIG. 4 is a generalized schematical block diagram of the control system of the invention.
Figure 6A:
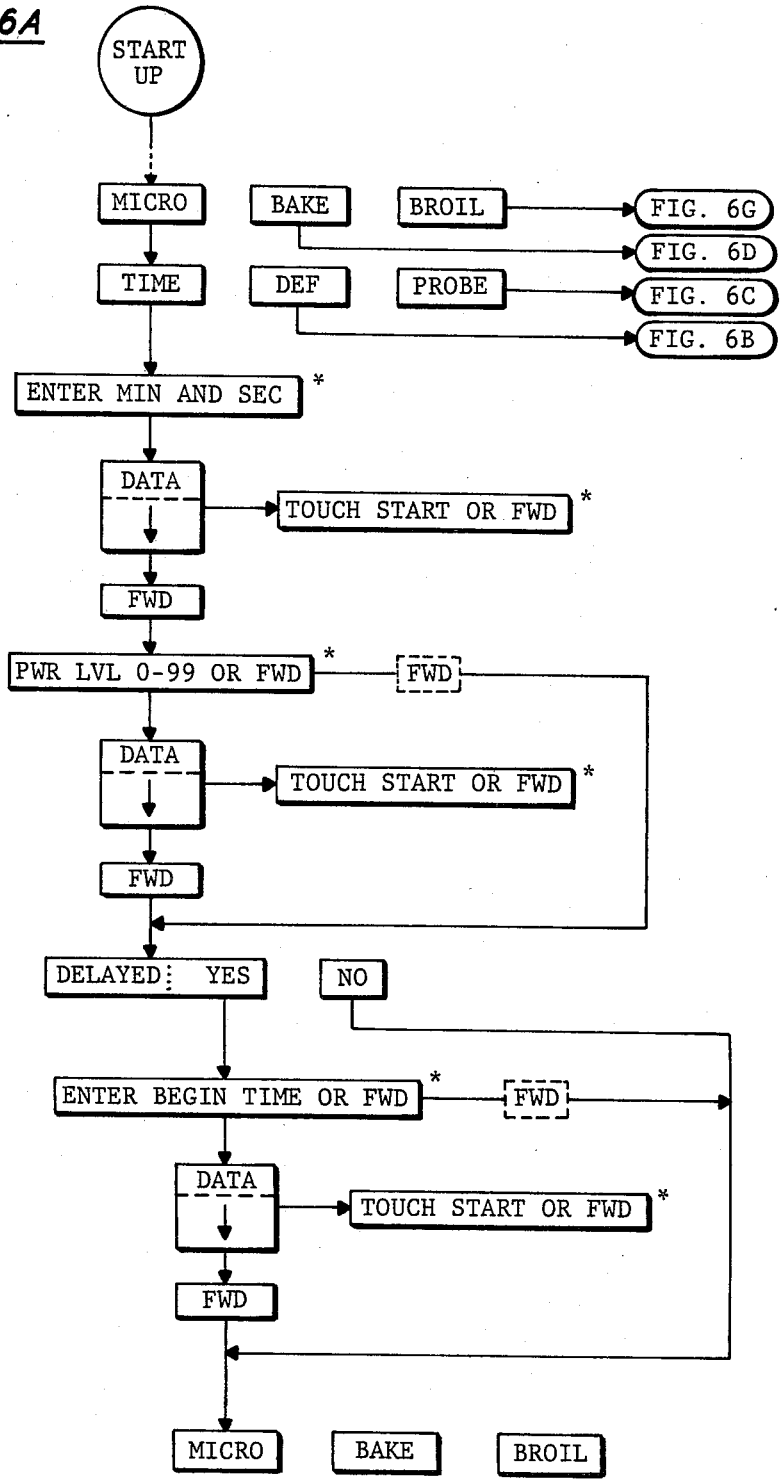
FIGS. 6*a*–6*k* are flow charts of representative operating mode sequences available for selection by the users.
Figure 6B:
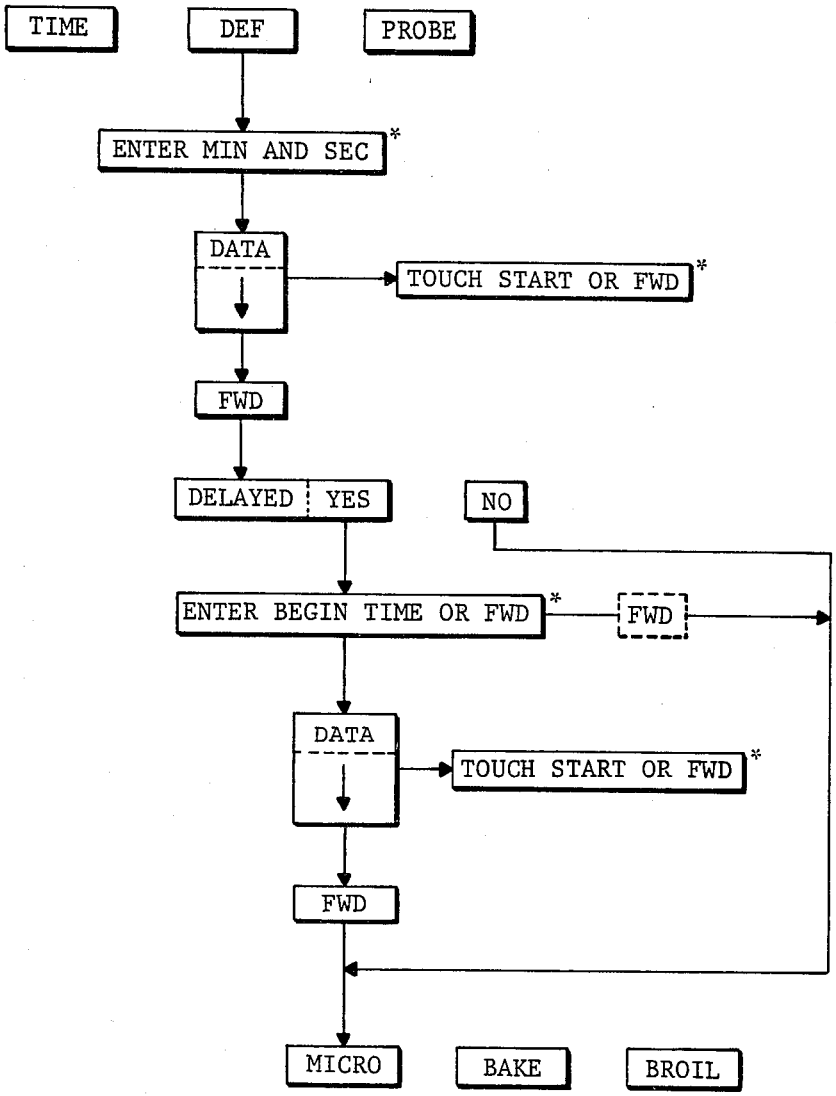
Figure 6C:
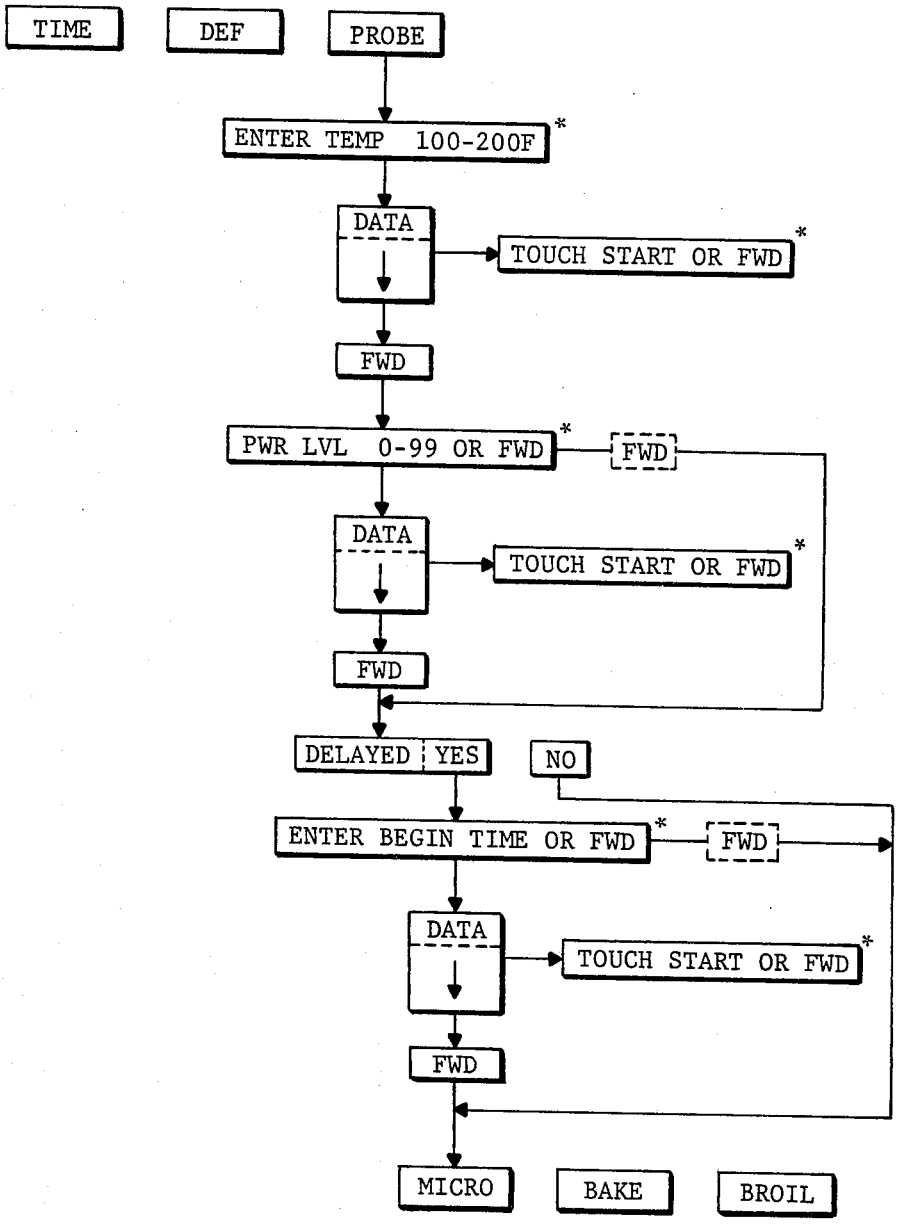
Figure 6D:
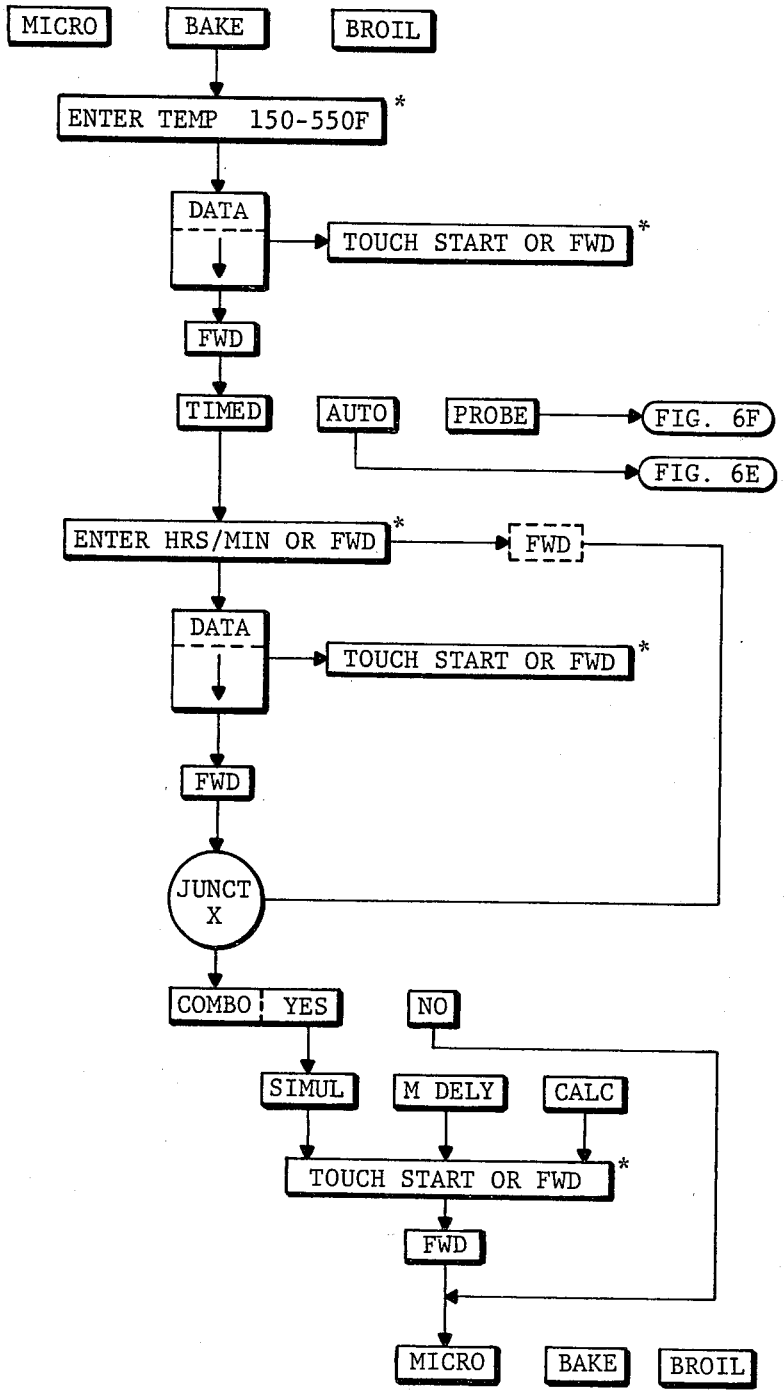
Figure 6E:
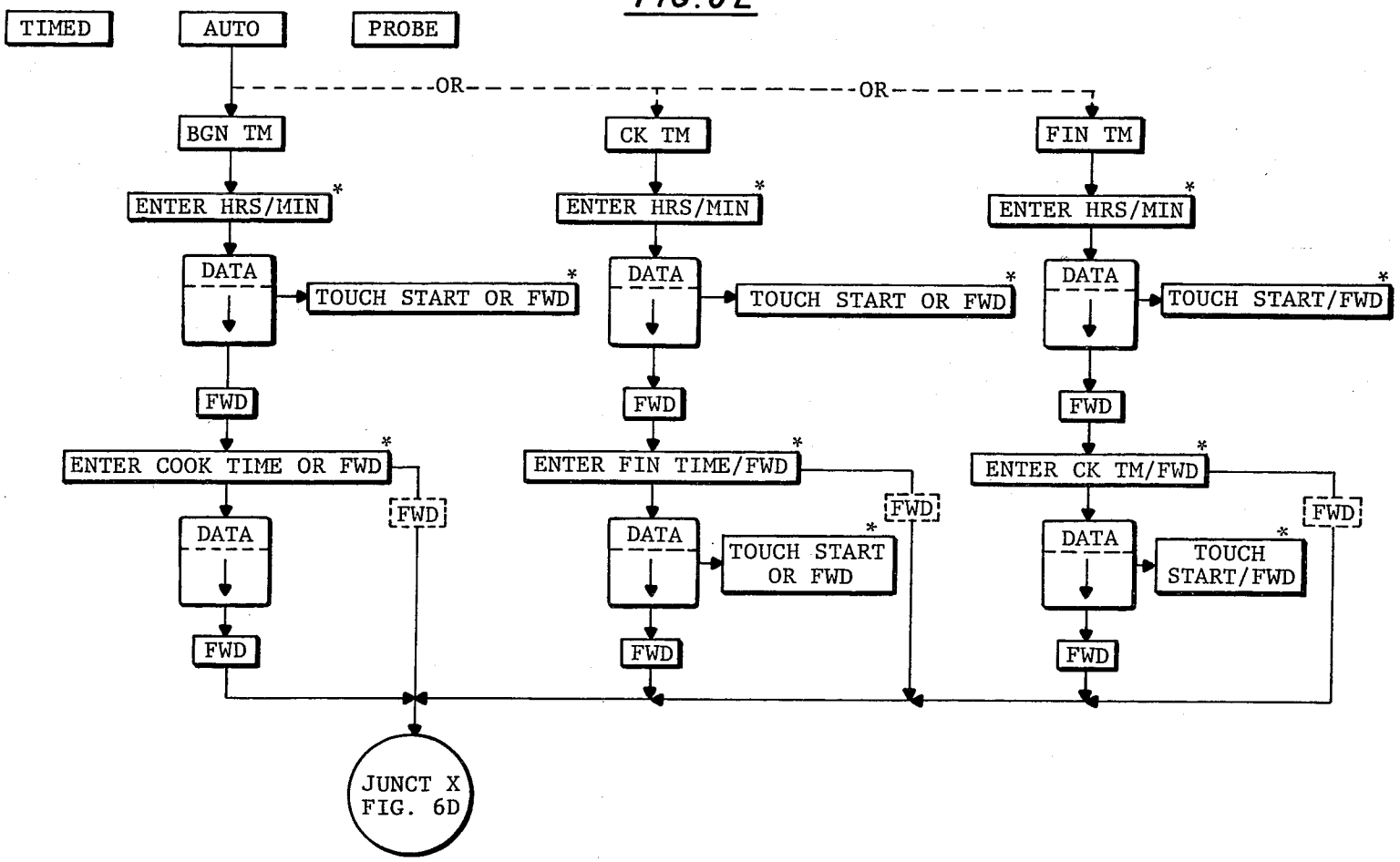
Figure 6F:
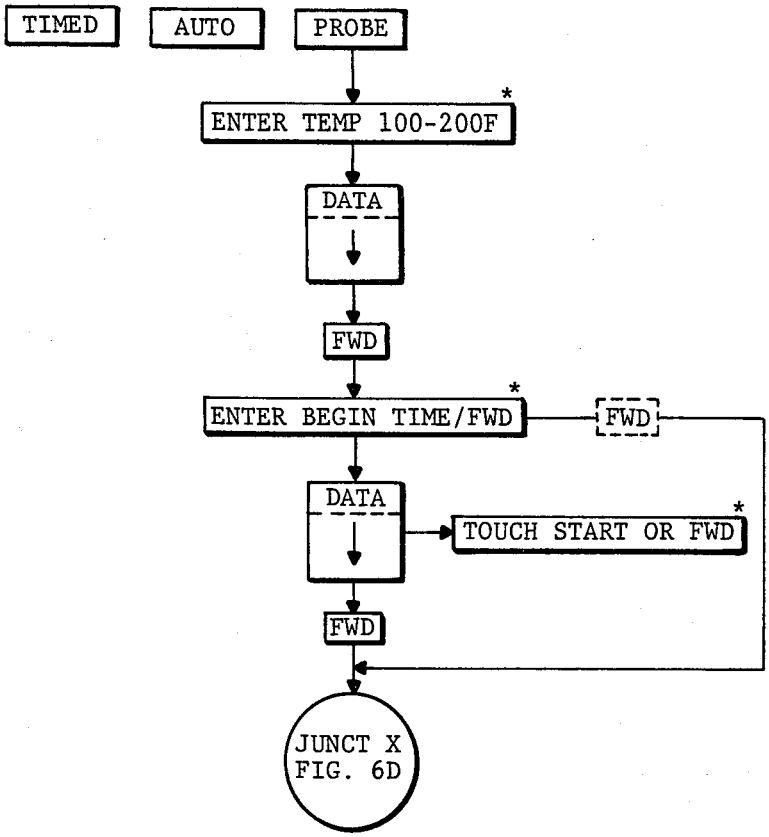
Figure 6G:
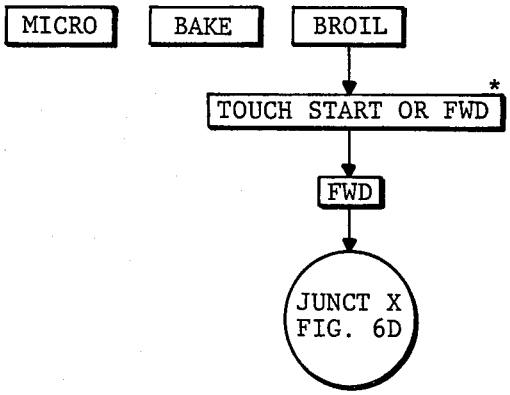
Figure 6H:
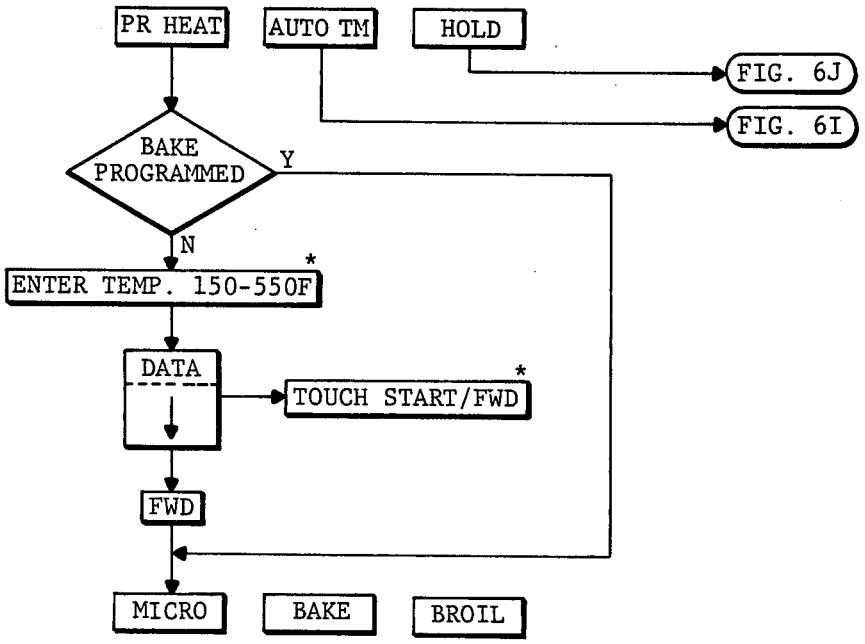
Figure 6I:
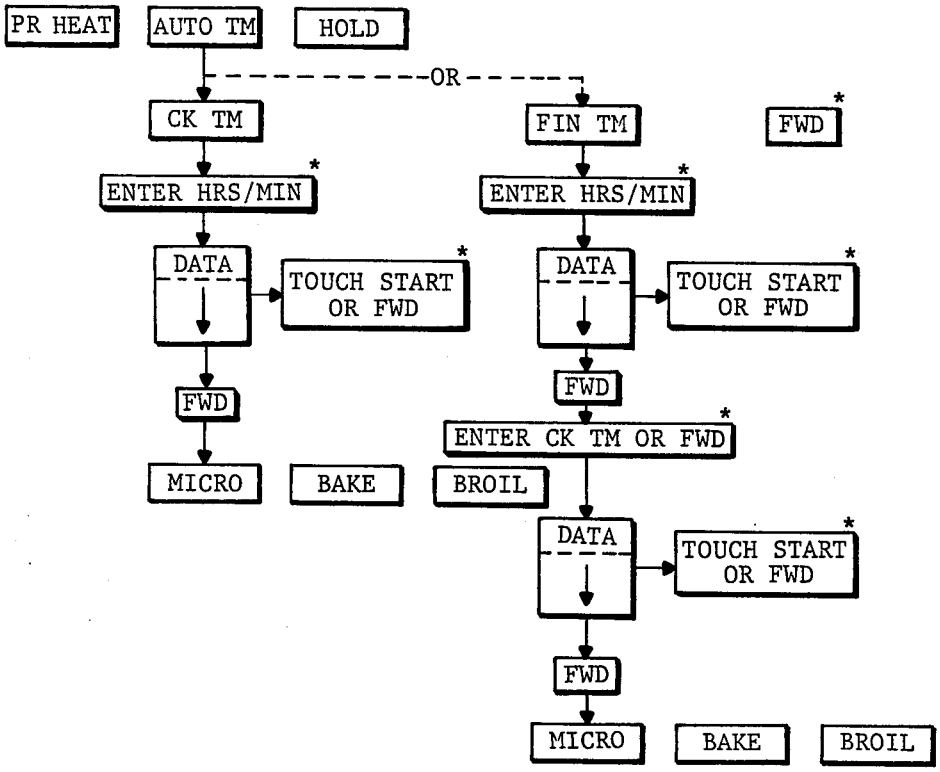
Figure 6K:
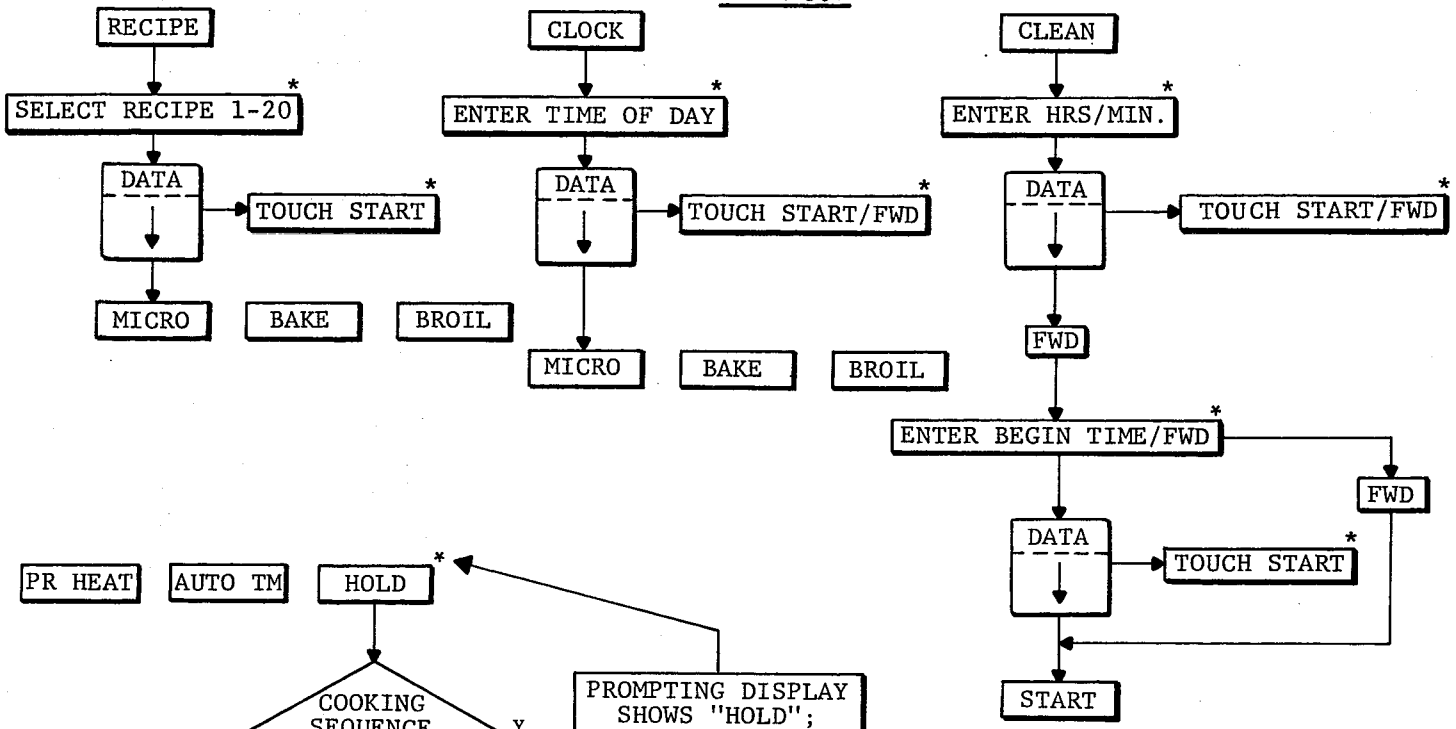
Figure 6J:
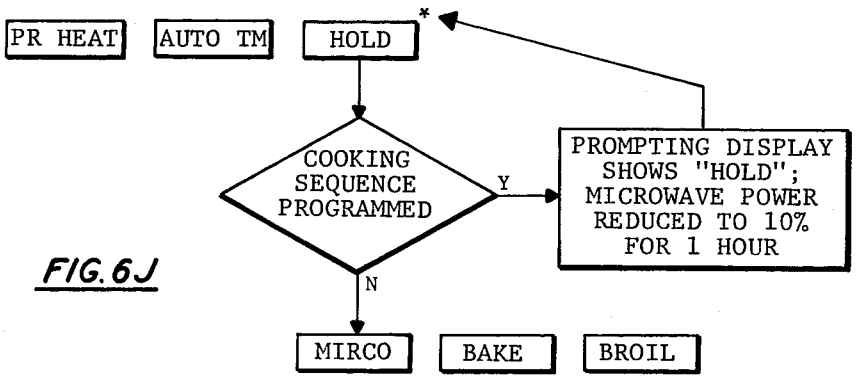

Similar to the keys 24 in the remaining portion of the control panel 22, the key pads 30 are also capacitive-type touch-responsive switches, each comprising a pair of serially-connected, parallel-plate capacitors having a suitable dielectric material between the plates. Referring to the section of key pad B illustrated in FIG. 3, the dielectric is transparent and is suitably formed of a sheet of glass 32. In fact, glass sheet 32 may form the structural foundation of the entire control panel 22 and also serve as the dielectric for dedicated touch pads 24. The intermediate plate of the serially-connected capacitors of the capacitive switch is formed by a suitable pad or rectangle of transparent conductive material, such as tin oxide 34 deposited on the upper surface of glass 32 in the region which defines the respective key pad. An opaque, insulating coating, such as ceramic paint 36 is applied to the remainder of the upper surface of glass plate 32 and extends to the boundaries of the tin oxide pad 34. The opposite end plates of the two series connected capacitors are formed by a pair of spaced conductive coatings 37 and 38 formed of silver paint or the like on the under surface of glass panel 32. Because the silver paint coatings may be opaque or translucent, sufficient spacing is provided between plates 37 and 38 to permit the user to see entirely through that key pad. Other conductive materials than silver, as for instance tin oxide, may be employed to form the lower plates 37 and 38 if dictated by economic considerations. One of the plates 37 or 38 for each key pad A, B and C must be separated from that corresponding plate on the other two pads, whereas the other plate may be common to all three of the pads to implify electrical connection. The end plates 37 and 38 of the respective adaptive switches A, B and C are connected as part of a conventional matrix which includes the dedicated capacitive switches 24 and the start and stop switches 21 and 23 respectively as illustrated in FIG. 4. A capacitive key pad 30 (or similarly 24) is actuated by simply touching the intermediate plate 34 which modifies the capacitance of the switch and accordingly alters a voltage level to provide a corresponding input signal associated with that switch.

An alterable display device 40 is positioned directly below and in visual registry with the transparent window portions of the adaptive switches A, B and C. Although individual display devices might be separately associated with each pad A, B and C respectively, certain economies of size, cost and operation may be realized if a single, multiple character display device shared by all three pads is employed. Accordingly, a twenty character alphanumeric fluorescent display panel manufactured and sold as 20-SY-03 by Futaba Corporation of Tokyo, Japan is employed as the display 40. Display 40 provides twenty separate characters each comprised of fourteen fluorescent segments and two punctuation marks. The display device 40 is thus capable of providing five or six characters per symbol for each of the variable key pads A, B and C. Moreover, narrow transparent channels 42 connect adjacent key pads A, B and C such that the combined key pads 30 may be utilized to display multi-word prompting statements. Channels 42 are simply regions of glass sheet 32 which have no coating on either side.

Referring again to FIG. 3, the sectional view of display device 40 depicts a transparent domed glass cover 43 mounted on and sealed to a glass substrate 44. A transparent conductive film 45 coats the inner undersurface of dome 43. A pair of filament cathode wires 46 extend the length of display device 40 beneath coating 45 and above a grid 47. A number of discrete fluorescent-coated anode segments 48 are supported on substrate 44 at each character position. Corresponding segment positions in each of the twenty characters are connected by a common conductor to which is connected a single terminal, for instance 49 which passes through the sealed glass housing. Each character includes a separate grid 47 having its own terminal (not shown) extending through the device housing. A particular character is energized and illuminated by applying an appropriate voltage to the corresponding grid terminal and to those segment terminals required to form the desired character.

Figure 2:
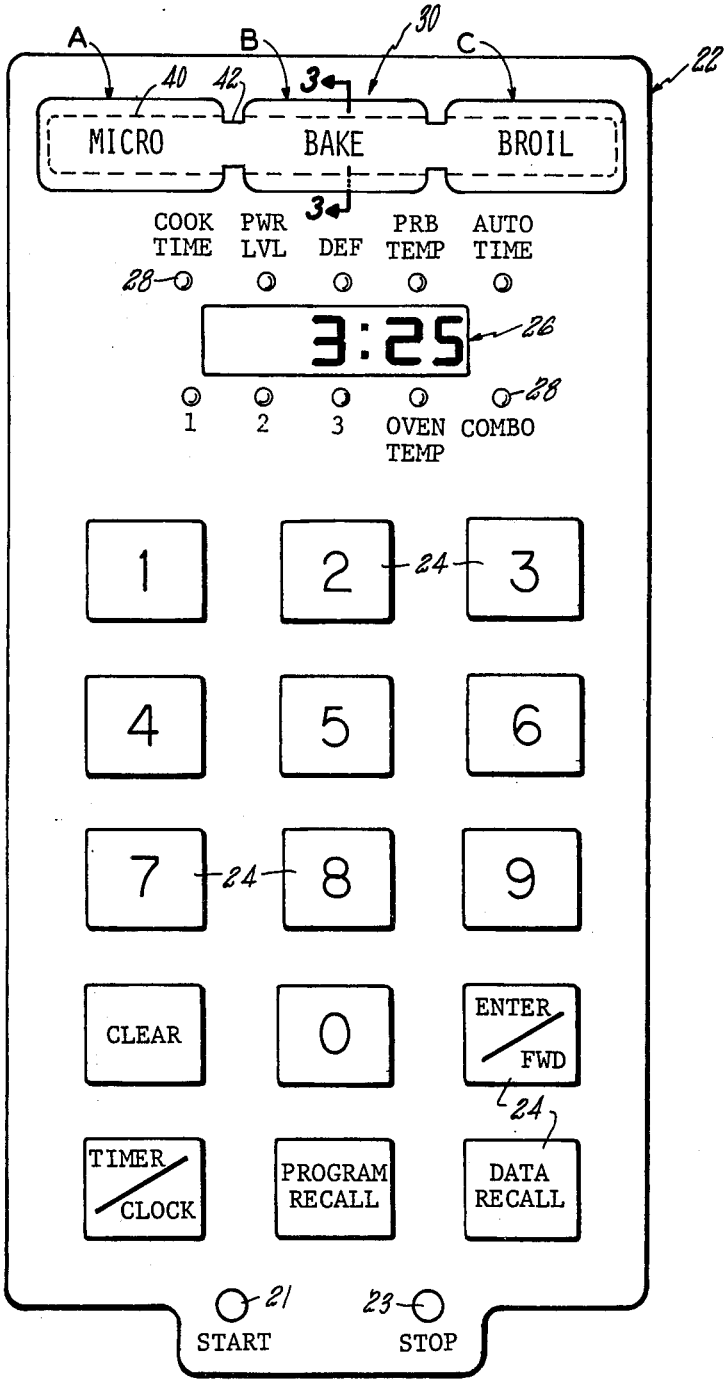
FIG. 2 is an enlarged view of the control panel of the oven of FIG. 1.

Referring to FIG. 4, the various input switches of control panel 22 in FIG. 2 are arranged in a four by five matrix 22'. The three variable switches are labelled A, B and C respectively. The mechanically actuated START and STOP switches 21 and 23 bear their respective indicia and the remaining dedicated capacitive keys 24 bear their respective indicia.

In addition to the input and the display devices of the control panel 22, a main portion of the control system of the invention is embodied in the microcomputers 50 and 52 illustrated in FIG. 4. Two microcomputers are utilized to afford the requisite storage and input/output ports, however, it will be understood that more or fewer microcomputers might be utilized depending on their capacities and/or the demands of the system. Each of the microcomputers 50 and 52 is typically a semiconductor MOS/LSI chip, as for example, of the type made and sold by Hitachi, Ltd. of Tokyo, Japan. Specifically in the illustrated embodiment, microcomputer 50 is an HMCS44A and the microcomputer 52 is an HMCS45A. Each of these microcomputers is a preprogrammed four-bit device including read-only-memory or storage (ROM), random access memory or storage (RAM), logic or central processing (CPU), appropriate input and output circuitry (I/O) and timing circuitry. Details of the internal architecture of the respective microcomputers may be found in the Hitachi product bulletin directed to the HMCS40 Series, which bulletin additionally sets forth the instruction set applicable to those microcomputers.

Briefly, microcomputers, or controllers, 50 and 52 each include a ROM having 2K by ten bit program memory and 128 by ten bit pattern memory. Each microcomputer also contains a 160 by four bit RAM. Microcomputer 50 includes 32 I/O ports and microcomputer 50 includes 44 such I/O ports, the greater number of ports in the latter being provided because of the relatively large number of outputs required from that microcomputer to the alphanumeric display device 40. Microcomputer 52 is dedicated in the main to the display of functions and statements on display device 40 at adaptive key pads 30. The microcomputer 50 is responsible for the overall control of oven 10, including control of the various output devices devoted to the actual cooking, control of the time display 26 and control of microcomputer 52. It will be appreciated that the particular microcomputers to which various functions are allocated may be altered as circumstances warrant.

The main control function of controller 50 relates to the magnetron (not shown) and the bake element 18 and broil element 16. Various digital output signals from output ports $D_{7-10}$ of controller 50 are extended through output interface circuitry 54 to various appliance load control devices such as magnetron triac gate 11, bake element relay 18', broil element relay 16', door lock solenoid 20' and the like. The control effected by these output signals is a function of their timing and duration, as is well known in the art. For instance, microwave cooking energy is controlled by the application of a control pulse to the magnetron triac gate and the power may be varied by varying the duty cycle of the magnetron.

The operation of the oven 10 is monitored for both safety and control purposes by means of information signals derived from various sensors, as for instance door closure sensor 55, oven temperature sensor 56 and food temperature probe 57. The status of door 20 is applied to an input $D_{12}$ of the controller 50 and is periodically sampled. The oven and food temperature signals are extended via a multiplexer 58 to an A-to-D converter 59 from which they are relayed as digital signals to an input port $D_{13}$ of controller 50 where they are periodically sampled. The analog to digital conversion is controlled by clock and reset signals provided to converter 59 from output ports $D_{14,\ 15}$ of controller 50.

A conventional power-up resetting signal is applied on line 60 to the RESET INPUTS of computers 50 and 52 for clearing and initializing the system, particularly upon power turn-on. A synchronization (SYNC) signal 62 is applied to an interrupt input INT 0 of controller 50 to provide a timing reference for certain of the timing functions provided by the controller. Specifically, the time of day and/or cooking time at display 26 and the duration of various controlled cooking functions are all referenced to this accurate 60 Hz source. An internal clock operating at approximately 400 kHz provides the timing reference for most of the internal computational and data handling operations of controllers 50 and 52. This internal clock is connected between controllers 50 and 52 by connection 63 extending between the respective OSC terminals.

The input switch matrix 22', comprised principally of capacitive touch pad switches including variable switches A, B and C, is sequentially repetitively scanned at a rapid rate, for instance about 80 Hz, by five scanning drive lines 68 extending from output ports $D_{0-4}$ of controller 50. The five scanning drive lines 68 are extended to five respective rows of the input switch matrix 22' through spring contacts 69. The status of the respective switches in the four columns of the matrix 22' is then sensed by four respective spring contacts 70 and transmitted via four respective conductors 71 (including interfacing comparator circuits, not shown) to inputs $R_{0-3}$ of controller 50. Touch contact actuation of any one of the switches in matrix 22' results in the entry within the RAM of controller 50 of a code comprised of two four-bit words indicative of actuation of a particular one of the twenty switches. If the indicated switch is one of the adaptive switches 30, the controller additionally identifies which function group is presently being displayed thereat and modifies the code accordingly to reflect that an adaptive switch having a particular function has been actuated. It will be understood that conventional key verification techniques are included to compensate for bounce and/or multiple key actuation and the like.

Various types of numerical data including an ongoing time of day display or a cooking time countdown display may appear on display 26. Controller 50 is operative in a known manner to receive numerical input data from the input switch matrix 22' and to maintain an accurate, updated display of real time at display 26. The drive lines 68 extending from output ports $D_{0-4}$ of controller 50 are also extended to five respective inputs on display module 26 for sequentially controlling the illumination of the four vacuum fluorescent digits and the accompanying colon. Correspondingly, an array of nine segment-energizing lines, one of which is represented by reference numeral 73 and the other eight of which are represented by reference number 74, extend from outputs $D_5$, $R_{20-23}$ and $R_{30-33}$ respectively to nine respective inputs on the display 26. Selective energization of seven of these lines by controller 50 determines the numeral to be displayed at each of the successively scanned digit positions, and the remaining two lines control illumination of the various annunciator lights 28 illustrated in FIG. 2.

The ROMs of controllers 50 and 52 each contain about 2,000 instruction words of ten bits per word. These instructions comprise the pre-stored program which, in combination with user-entered programming, controls operation of the system. The various function and prompting messages to be hereinafter discussed are stored in "look-up" tables in ROM. The RAMs of controllers 50 and 52 each contain 160 memory words having four bits per word. The RAM may store information entered by the keyboard, intermediate and final results of calculations, status information of "flags", and other working data. The RAMs function as the working registers of the system. The controllers include conventional circuitry for addressing the RAMs and similarly include program counters for addressing the ROM to obtain the requisite instruction words.

The control scheme implemented by the controller 52 is similar in certain respects to that disclosed in the aforementioned U.S. Pat. No. 4,011,428 to Fosnough et al and a limited reliance is placed on that herein incorporated disclosure for generalized instruction in the use of integrated digital control systems for controlling the operation of a microwave oven. However, the present oven 10 is provided with a greater number of microwave and/or thermal cooking sequences than were provided in the oven of that patent.

The alterable key pads 30 facilitate programming various operating sequences of the oven by the user without unduly increasing the size of control panel 22. These adaptive key pads 30 permit the oven's operating sequences to be divided into a plurality of higher order, or principal, operating modes and a plurality of secondary operating modes, with separate identifying symbols being available for each of the principal and each of the secondary operating modes. Those operating mode-identifying symbols are represented by instruction words contained in the read-only-memory of controller 52 and are arranged in groups of symbols. More specifically, each symbol group will typically include three symbols for display at the key pads A, B and C respectively of adaptive display 30. Correspondingly, those key pads A, B and C will then function as input devices for selecting the particular operating modes displayed thereon.

The relatively large number of digit and segment drive inputs to alphanumeric display 40 are provided by the relatively large number of outputs from the Hitachi HMCS45A microcomputer 52. The twenty characters or digits capable of being displayed by display 40 are controlled by the digit drive outputs $D_{0-15}$ and $R_{60-63}$ of controller 52, each having a scan rate of about 80 Hz. The control of the fourteen segments and two punctuation marks which make up each digit or character is effected by sixteen segment drives provided by outputs $R_{00-03}$, $_{10-13}$, $_{20-23}$ and $_{30-33}$. A pair of filament leads 46 extend from a suitable AC supply (not shown) to the display 40.

Referring to FIG. 5*a*, and in accordance with an aspect of the present invention, the various operating sequences performable by the oven 10 and its associated control system are identified by a number, in this instance nine, principal operating modes having the respective symbols MICRO, BAKE, BROIL; PREHEAT, AUTOTM, HOLD; RECIPE, CLOCK, CLEAN; and by various secondary operating modes having, in this instance, the respective symbols TIME, DEF, PROBE; DELAYED YES, NO; CK TM, FIN TM/FWD; SIMULT, M DELY, CALC; TIMED, AUTO, PROBE; COMBO YES, NO. It will be observed that these operating modes and their symbols are generally arranged in groups of three, which symbols in a group are respectively displayed at key pads A, B and C in accordance with a certain hierarchy. Of the three principal groups of operating modes, one group, i.e. MICRO, BAKE, BROIL, is dominant over the other two in the hierarchy as will become hereinafter evident.

A number of prompting statements defined by instruction words are also included in the ROM of controller 52, illustrations of such statements being listed in FIG. 5*b*. Each line of the FIG. 5*b* list illustrates a prompting statement which may be displayed at the adaptive display 30 in accordance with certain logic based on the functional operating modes previously selected by the user's actuation of the adaptive key pads 30, as illustrated in the flow charts of FIGS. 6*a*–6*k*. The prompting statements assist the user in the operation of the dedicated keys on control panel 22.

Although the instruction words which define the various operating mode symbols of each group and which define the various prompting statements are stored in the ROM of controller 52, the control logic which determines the sequence in which those symbols and/or statements are called forth for display is established in the program stored in controller 50 and is a function also of the manual input control action taken by the user. Certain prompting statements, such as ENTER TIME OF DAY, may be displayed upon startup of the control system to instruct in the entry of the initial conditions. The programmed logic of controller 50 then establishes that the dominant principal operating mode group comprised of MICRO, BAKE, BROIL is the first of the operating mode symbol groups to be displayed after control system startup. Moreover, the internal logic is conditioned to recognize inputs from keys A, B and C as representing Microwave, Bake and Broil mode control input signals respectively. If neither the MICRO, BAKE nor BROIL mode is to be selected, but instead it is desired to display and possibly select one of the other principal modes, the dedicated switch marked FWD (forward) is actuated on control panel 22. The logic of controller 50 then calls forth for display from controller 52 the mode symbols for one of the remaining groups of principal operating modes, i.e. PRHEAT, AUTOTM and HOLD. At that time the displays associated with touch pads A, B and C change to reflect the PRHEAT, AUTOTM and HOLD designations and the logic circuitry of controller 50 is then conditioned to respond to inputs from touch pads A, B and C as input commands for those designated modes respectively.

On the other hand, if the user wishes to select operation in one of the displayed modes, i.e. microwave cooking when the MICRO, BAKE and BROIL modes are displayed, it is only necessary to touch-actuate the appropriate pad, i.e. pad A bearing the designation MICRO. Upon actuation of that adaptive pad A, the RAM of controller 50 stores the program instruction, or instructions which will effect operation of the oven in the microwave mode and the controller advances to the next step in programming the microwave cooking sequence, as illustrated in FIG. *6a*. Specifically, a group of three secondary operating mode symbols, i.e. TIME, DEF and PROBE are displayed at pads A, B and C respectively. Correspondingly, the controller 50 then becomes conditioned by prior program to respond to actuation of one of the pads A, B or C to provide the appropriate TIME, DEFROST or PROBE mode control program instruction to the RAM and to display any prompting instruction which is appropriate.

For example, referring to FIG. *6a*, if touch pad A displaying TIME is actuated, controller 50 responds by commanding controller 52 to display a particular prompting statement, i.e. ENTER MIN AND SECS. That prompting statement is displayed across substantially the full length of display element 40 and thus across substantially the entirety of adaptive display 30 and control panel 22. This prompting statement is intended to instruct the user regarding the use of the various dedicated input switch pads 24, either for the entry of numerical data or for entering some fixed functional command. The appropriate response by the user to the ENTER MIN AND SECS statement displayed in FIG. *6a* would be the actuation of various selected touch pads 24 to enter the appropriate microwave cooking time in minutes and seconds, beginning with the most significant digit first.

Upon the user's entry of the first such digit, the controller 50 is automatically conditioned to request display by controller 52 of another prompting statement, i.e. TOUCH, START OR FWD. This statement remains displayed on display 40 until completion of the entry of data by the user, whereupon the user may either actuate the touch pad 24 designated START or that designated FWD. If START is actuated, the control system begins execution of the various stored instructions or program entered by the user and the oven 10 will begin a timed microwave cooking of the contents.

If, however, the FWD pad is actuated as represended by the rectangular box designated FWD below the DATA box in FIG. *6a*, the programming and display sequence will continue with, in this instance, the display of another prompting statement, i.e. PWR, LVL, 0–99 or FWD. The magnetron normally operates at a 100% power level and in this instance the user has the option of either maintaining the 100% power level by actuating the FWD pad 24 or selecting some lower power level by entering a numeral representative of a multiple of 10% of full power. For instance, entry of a "5" will result in operation at the 50% power level.

Upon entry of that first numeral, the prompting statement TOUCH START OR FWD is again displayed. Actuation of the START touch pad initiates the cooking operation as previously described, whereas actuation of the FWD pad results in the display of yet two other operating mode symbols, i.e. DELAYED YES, NO. The user must then decide whether to delay the initiation of microwave cooking by actuating the YES Pad, B, or to proceed directly to the redisplay of the dominant primary mode symbols MICRO, BAKE and BROIL for additional selections thereunder. If delayed starting of microwave cooking is desired and pad B is actuated, a prompting statement ENTER BGN TIME/FWD is displayed and the user may enter a precise time at which microwave cooking is to begin. If, after selecting Delayed microwave cooking and before entering a time, the user wishes not to pursue Delayed cooking, he may actuate the FWD pad 24 and advance to the redisplay of the dominant mode symbols MICRO, BAKE and BROIL.

Upon entering the first digit of the beginning time data for the microwave cooking, the controller 50 directs controller 52 to display prompting statement TOUCH START OR FWD once again. By touching the START pad, the oven will begin microwave cooking at the designated beginning time. Otherwise, actuation of the FWD pad instructs redisplay of the dominant MICRO, BAKE and BROIL symbol group.

Upon this redisplay of the dominant operating modes, the user has the option of further programming under the microwave mode by again actuating touch pad A on which MICRO is displayed. This redisplays the secondary modes TIME, DEF and PROBE for selection of either the DEF (defrost) or PROBE modes of cooking as illustrated in FIGS. *6b* and *6c* respectively. Alternatively, and/or additionally the user may elect to also program BAKE or BROIL modes of cooking as illustrated in FIGS. *6d* and *6g* respectively, which modes may include suborindate or secondary operating mode routines depicted in FIGS. *6d*, *6e* and *6f* as well. Alternatively or subsequently, the user may elect to display the other principal operating modes. This is done by actuating the FWD pad which results in the display of the principal operating mode symbol group comprised of PRHEAT, AUTOTM and HOLD. Programming under those operating modes may then proceed as illustrated in FIGS. *6h, 6i* and *6j*. Instead, or subsequently, the user may reactuate the FWD touch pad and effect display of the final principal operating mode symbol group, i.e. RECIPE, CLOCK, CLEAN. The several programming routines available to the user under those operating modes are illustrated in FIG. *6k*.

No further detailed discussion of most of the flow diagrams in FIGS. *6a–6k* will be undertaken inasmuch as they are believed to be essentially self-explanatory. Each of the prompting statements has been identified by an asterisk in those figures. The boxes designated FWD in those figures represent the actuation of the dedicated contact pad 24 designated FWD.

Referring to FIG. *6j*, the HOLD operating mode, if actuated by the user, determines through the internal logic of controller 50 whether or not a cooking sequence has already been programmed. If such a cooking sequence has been programmed, actuation of the HOLD pad C results in the microwave power being reduced to 10% at the completion of the cooking sequence and held there for one hour. Alternatively, if a cooking sequence has not been programmed, the dominant display of MICRO, BAKE and BROIL appears at adaptive display 30 to allow programming of a cooking sequence.

Referring to FIG. *6k*, a number of recipes, i.e. 20, having specific cooking times and applications of microwave and/or thermal energy at certain power levels may be preprogrammed and stored in the ROM of controller 50. Each of these recipe programs may be identified and selected by a respective number from 1 to 20 entered from key pads 24 when the SELECT RECIPE 1–20 prompting statement is displayed. A supplemental manual will assist the user in determining which recipe number should be selected for cooking a particular food item. The electrical connections 80 and 81 from port $D_6$ on controller 50 to port INT1 on controller 52 and from port $D_0$ of controller 52 to port INT1 on controller 50 respectively provide the requisite connection between the two controllers for the exchange of recipe information.

Figure 7:
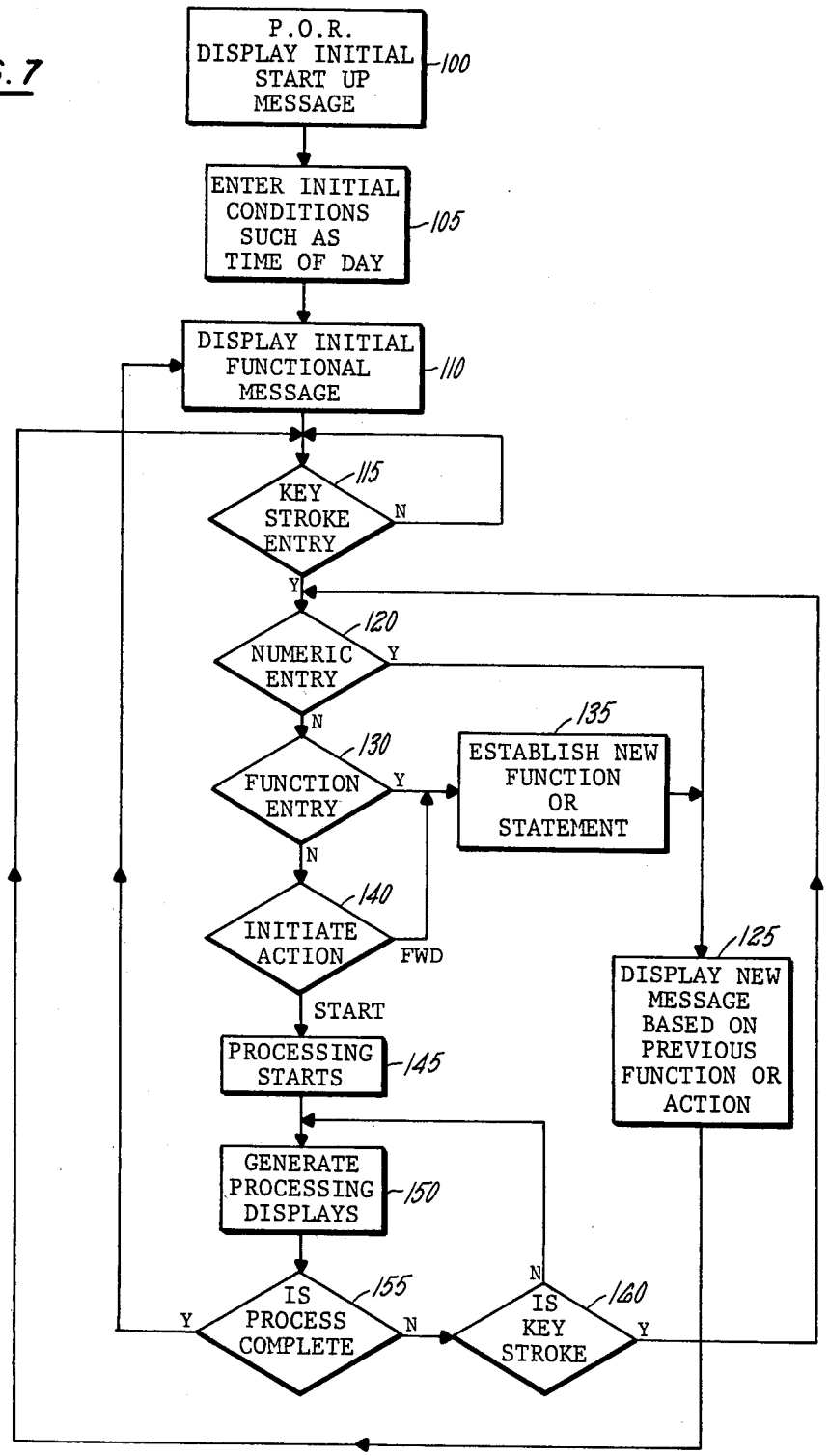
FIG. 7 is a generalized flow chart of the routines associated with the adaptive control panel and control system.

Reference is made to the flow chart of FIG. 7 which depicts in generalized form the aforementioned routines associated with data and function entries and with the alphanumeric display 40 associated with adaptive key pads 30. Upon powering up the system, the various registers are cleared and/or initialized and one or more startup messages, such as ENTER TIME OF DAY, may be displayed at display 40, as indicated by block 100. The user then responds to the messages, as by entering the time of day, as represented by block 105. Following establishment of these initial conditions, the system is ready for the user to begin programming the cooking sequences desired. Accordingly, the dominant principal function group, i.e. MICRO, BAKE, BROIL is called from memory and displayed at display 40, as represented by block 110. Concomitantly, the controller is conditioned to identify inputs from key pads A, B or C as representing the specific functions displayed at the respective pads.

The decision block 115 monitors whether or not an entry has been made from either a dedicated key 24 or an adaptive key pad 30. If not, the monitoring function continues. If an entry has been made, it is reviewed to determine if it is a numeric entry represented by block 120 and if so, a new display of a prompting statement at pads 30 is generated, as represented by block 125. The most common display under those circumstances is the statement "TOUCH START OR FWD".

In the event the key stroke entry of block 115 was not numeric, logic represented by block 130 determines whether or not the entry is a function. If it is, the system logic calls for the establishment of a new function or prompting statement, represented by block 135, and the appropriate display at key pads 30 is effected by the block 125.

If the key stroke represents neither a number nor a function, it will represent actuation of either the FWD key or the START key, as determined by logic block 140. If the former, the logic of blocks 135 and 125 effects the initiation and display of a new set or group of functions at pads 30. If the latter, the block 145 represents initiation of the execution of the program which the user has stored. Various displays monitor the execution of the program, as for instance via a countdown time appearing on display 26 and the program status appearing on the annunciators 28, represented by block 150. The adaptive key pad 30 may also be used for displaying certain aspects of the program being excecuted.

The decision block 155 monitors the execution of the program to determine whether or not it is complete. If not complete, decision block 160 determines whether or not a key is being actuated and if so, the analysis of blocks 120, 130 and 140 is performed. Such entries are normally to stop and/or modify the programmed process. If no key is being stroked, the processing displays continue to be generated. When the process is complete, the dominant function group of MICRO, BAKE, BROIL is again displayed at keys 30.

The overall operating sequence or program selected for oven 10 by the user, which typically is comprised of a plurality of component sequences, is stored in the RAM associated with controller 50, awaiting execution upon actuation of the START pad 24. This programmed sequence will be identified by selected instructions or control codes associated with the primary and/or secondary operating modes and by the numerical data which identifies power levels, cooking time durations and/or cooking start and stop times.

As an alternative to the electronic storage of symbol-forming instructions in the ROM of controller 52 and to the utilization of fluorescent display device 40, an electromechanically operated drum having the symbols or indicia for the various operating modes and prompting statements appropriately grouped thereon might instead be used. The indicia or symbols on the drum would be cause to rotate into registry with the transparent touch pads A, B and C in accordance with electrical control instructions provided by controller 50.

Although this invention has been shown and described with respect to detailed embodiments thereof, it will be understood by those skilled in the art that various changes in form and detail thereof may be made without departing from the spirit and scope of the claimed invention.

I claim:

1. A control system for an appliance having controlled devices operative in a plurality of selectable modes, each said mode comprising one or more respective operating sequences, said control system including storage means and electronic control means operable to effect the operating sequences of selected ones of said modes, representations of a plurality of symbols being stored in said storage means, said representations being representative of respective ones of said operating modes, display means, means for retrieving said symbol representations from storage and displaying said representations so retrieved at said display means as corresponding symbols in a plurality of groups of symbols, each said symbol group having at least one symbol and being displayed separately in time from the other said groups, respective manually operated adaptive input means associated with and positioned in visual proximity with each symbol in a said displayed group of symbols, said electronic control means being responsive to operation of a said adaptive input means during display of a respective mode symbol thereat for subsequently effecting the operating sequence associated with the respective said displayed mode symbol, and further including a plurality of manually operated dedicated input means each being for the input of fixed data to said control means and storage means, said control means and storage means being responsive to the input of said data from said dedicated input means directly following operation of a particular said adaptive input means during display of a respective particular mode symbol thereat for at least partly defining said operating sequence of said respective operating mode.

2. The control system of claim 1 including manually operated dedicated input means for the input of a sequence initiating start command signal, set electronic control means being responsive to the input of said start command signal for initiating control of the appliance devices in accordance with the operating modes and sequences previously selected.

3. The control system of claim 1 wherein said storage means stores representations of a plurality of prompting statements, said control means also serving to retrieve and to display at said display means predetermined ones of said prompting statement representations as respective prompting statements subsequent to the display thereat of respective operating mode symbols and prior to said input of fixed data for the respective displayed operating modes, said prompting statements being instructive in said input of fixed data.

4. The control system of claim 3 wherein said operating modes comprise a plurality of principal operating modes and a plurality of secondary operating modes, at least one of said principal operating modes being comprised of a plurality of alternately selectable ones of said secondary operating modes, and said symbols representative of said secondary operating modes being displayed in one or more groups different from said groups of symbols representative of said principal operating modes and only subsequent to operation of said adaptive input means during display of a symbol representative of a said principal operating mode.

5. The control system of claim 1 wherein at least one group of said groups of symbols comprises at least two symbols.

6. The control system of claim 5 wherein at least one group of said groups of symbols comprises three symbols.

7. The control system of claim 6 wherein there are at least three said manually operated adaptive input means associated with said groups of symbols, most of said groups of symbols being comprised of the same number of said symbols as said number of said adaptive input means, and at least one of said symbols in each said group comprising four discrete characters.

8. The control system of claim 1 wherein said symbol representations in storage have respective symbol group storage addresses and wherein said means for retrieving said symbol representations from storage includes manually operated dedicated input means for generating a stepping command to step the address controlling said symbol group displayed thereby to display a subsequent one of said symbol groups.

9. The control system of claim 1 wherein each said adaptive input means includes a manually operated key pad switch, said key pad switch including a transparent window portion superimposed over said display means to establish visual coincidence of said key pad and said display means such that a said displayed symbol associated with a key pad is visible through the window portion of the respective said key pad.

10. The control system of claim 4 wherein each said adaptive input means includes a manually operated key pad switch, said key pad switch including a transparent window portion superimposed over said display means to establish visual coincidence of said key pad and said display means such that a said displayed symbol associated with a key pad is visible through the window portion of the respective said key pad.

11. The control system of claim 10 wherein each said key pad comprises a touch responsive capacitive switch.

12. The control system of claim 11 wherein said display means comprises a multi-segment, multi-character display panel.

13. The control system of claim 12 wherein a said group of symbols includes at least three symbols, at least one of said symbols comprising five discrete characters, and said display panel displaying all three symbols of said group thereon.

14. The control system of claim 10 including a plurality of manually operated dedicated input means each being for the input of fixed data to said control means and storage means, said control means and storage means being responsive to the input of said data from said dedicated input means directly following operation of a particular said adaptive input means during display of a respective particular mode symbol thereat for at least partly defining said operating sequence of said particular operating mode and wherein said symbol representations in storage have respective symbol group storage addresses and said means for retrieving said symbol representations from storage includes manually operated dedicated input means for generating a stepping command to step the address controlling said symbol group displayed thereby to display a predetermined subsequent one of said symbol groups.

15. The control system of claim 14 wherein one of said predetermined subsequent ones of said symbol groups is said dominant symbol group, said dominant symbol group being again automatically retrieved and displayed following input of said data.

16. The control system of claim 14 wherein said storage means additionally stores representations of a plurality of prompting statements, said control means also serving to receive and display predetermined ones of said prompting statement representations as respective prompting statements at said display means subsequent to the display thereat of respective operating mode symbols, said prompting statements being informative in the utilization of said dedicated data input means.

17. The control system of claim 14 wherein each said symbol is intuitively representative of its respective said operating mode.

18. A control system for an appliance having controlled devices operative in a plurality of selectable modes, each said mode comprising one or more respective operating sequences, said control system including storage means and electronic control means operable to effect the operating sequences of selected ones of said modes, representations of a plurality of symbols being stored in said storage means, said representations being representative of respective ones of said operating modes, display means, means for retrieving said symbol representations from storage and displaying said representations so retrieved at said display means as corresponding symbols in a plurality of groups of symbols, each said symbol group having at least one symbol and being displayed separately in time from the other said groups, respective manually operated adaptive input means associated with and positioned in visual proximity with each symbol in a said displayed group of symbols, said electronic control means being responsive to operation of a said adaptive input means during display of a respective mode symbol thereat for subsequently effecting the operating sequence associated with the respective said displayed mode symbol, said operating modes comprising a plurality of principal operating modes and a plurality of secondary operating modes, at least one of said principal operating modes being comprised of a plurality of selectable ones of said secondary operating modes, and said symbols representative of said secondary operating modes being displayed in one or more groups different from said groups of symbols representative of said principal operating modes and only subsequent to operation of said adaptive input means during display of a symbol representative of a said principal operating mode, said symbols representative of said primary and said secondary operating modes respectively being displayed on common said display means.

19. The control system of claim 18 wherein at least one group of said groups of principal operating mode symbols comprises three said symbols and at least one group of said groups of secondary operating mode symbols comprises three said symbols.

20. The control system of claim 18 wherein said symbol representations in storage have respective symbol group storage addresses and wherein said means for retrieving said symbol representations from storage includes manually operated dedicated input means for generating a stepping command to step the address controlling said principal operating mode symbol group displayed thereby to display a different one of said principal operating mode symbol groups.

21. The control system of claim 18 wherein said principal operating modes are represented by a plurality of said groups of symbols including one said group representing dominant operating modes, and said means for retrieving said symbol representations from storage initially automatically retrieves and displays said dominant symbol group prior to the retrieval and display of any of the other said groups.

* * * * *